US007815085B2

(12) United States Patent
Sasaki et al.

(10) Patent No.: US 7,815,085 B2
(45) Date of Patent: Oct. 19, 2010

(54) COMBUSTION TYPE DRIVING TOOL

(75) Inventors: Yasuo Sasaki, Ibaraki (JP); Yasuki Ohmori, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 135 days.

(21) Appl. No.: 12/015,739

(22) Filed: Jan. 17, 2008

(65) Prior Publication Data

US 2009/0008423 A1 Jan. 8, 2009

(30) Foreign Application Priority Data

Jan. 19, 2007 (JP) ..... P2007-009837

(51) Int. Cl.
*B25C 1/04* (2006.01)

(52) U.S. Cl. ..... 227/8; 227/10; 227/130

(58) Field of Classification Search ..... 227/130, 227/8, 10; 123/46 SC
See application file for complete search history.

(56) References Cited

U.S. PATENT DOCUMENTS

| | | | | |
|---|---|---|---|---|
| 4,403,722 | A | 9/1983 | Nikolich | |
| 4,483,280 | A | 11/1984 | Nikolich | |
| 4,483,473 | A | 11/1984 | Wagdy | |
| 4,522,162 | A | 6/1985 | Nikolich | |
| 4,721,240 | A * | 1/1988 | Cotta | 227/10 |
| 5,191,861 | A * | 3/1993 | Kellerman et al. | 123/46 SC |
| 5,197,646 | A * | 3/1993 | Nikolich | 227/8 |
| 5,687,898 | A * | 11/1997 | Toulouse | 227/8 |
| 5,687,899 | A * | 11/1997 | Dohi et al. | 227/10 |
| 5,971,245 | A * | 10/1999 | Robinson | 227/10 |
| 6,145,510 | A * | 11/2000 | Clark | 131/256 |
| 6,318,615 | B1 * | 11/2001 | Walter | 227/10 |
| 6,619,527 | B1 * | 9/2003 | Moeller | 227/10 |
| 6,889,885 | B2 * | 5/2005 | Ohmori | 227/10 |

FOREIGN PATENT DOCUMENTS

| | | |
|---|---|---|
| JP | 134753 | 7/1989 |
| JP | 325307 | 4/1991 |
| JP | 411337 | 2/1992 |
| JP | 753907 | 12/1995 |
| JP | 08052666 | 2/1996 |

* cited by examiner

*Primary Examiner*—Scott A. Smith
(74) *Attorney, Agent, or Firm*—McDermott Will & Emery LLP

(57) ABSTRACT

A combustion type driving tool including a combustion chamber frame which is provided in a housing, and can move in one direction and in the other direction thereby to define a combustion chamber when it has moved in the other direction, moving means which can select either of a manual operation valid state and a manual operation invalid state, and permits the combustion chamber frame to move in the other direction by manual operation, only in the manual operation valid state, and a link mechanism. The link mechanism has a connection part 81 connected to the combustion chamber frame at its one end, an operation part which can be pressed at its other end, and a rotation shaft provided between the connection part and the operation part and extending in a direction substantially perpendicular to a moving direction of the combustion chamber frame to be selectively positioned, wherein the operation part rotates around the rotation shaft when it is manually pressed, and the connection part can move in the other direction.

3 Claims, 4 Drawing Sheets

COMBUSTION TYPE DRIVING TOOL

CROSS-REFERENCE TO RELATED APPLICATIONS

This application is based on and claims the benefit of priority from the prior Japanese Patent Application No. 2007-009837, filed on Jan. 18, 2007; the entire contents of which are incorporated herein by reference.

TECHNICAL FIELD

The present invention relates to a driving tool, and more particularly, relates to the driving tool of combustion type.

BACKGROUND

In a driving tool of combustion type, for example, a combustion type nail driving machine, a combustion chamber frame is provided in a housing thereof. When the combustion chamber frame is pushed upward, the combustion chamber frame is pressed to a head cap which is positioned above the combustion chamber frame, whereby a combustion chamber is formed in a space defined between the combustion chamber frame and the head cap. A driving power for striking a nail is obtained, by burning combustible gas inside this combustion chamber.

As disclosed in Patent Documents 1 to 3, the combustion chamber frame is pushed upward by pushing a push lever which is connected to the combustion chamber frame. Specifically, the push lever is provided in a nose part which is arranged at an end of the housing positioned below the combustion chamber frame and supports a nail to be driven out, and when the nose part is brought into contact with a driven member, the push lever is also brought into contact with the driven member simultaneously, whereby the combustion chamber frame which moves in association with the push lever is pushed upward.

In some cases, the driving tool is used for attaching a connection metal to a wood, for example. In this case, it is necessary to drive a fastening piece such as a nail into the wood through a hole formed in the connection metal, and therefore, a driving position must be accurately restricted.

As means for performing accurate driving, such a structure that besides a piston for driving the nail, a sub piston is provided to protrude a distal end portion of the nail for enhancing visibility, as disclosed in Patent Document 4, and such a structure that the nail is driven into a position where the push lever is in contact with the driven member, as disclosed in Patent Document 5 are publicly known.

[Patent Document 1]
Japanese Patent Publication No. JP-B-H01-34753
[Patent Document 2]
Japanese Patent Publication No. JP-B-H03-25307
[Patent Document 3]
Japanese Patent Publication No. JP-B-H04-11337
[Patent Document 4]
Japanese Patent Publication No. JP-B-H07-53907U
[Patent Document 5]
Japanese Patent Publication No. JP-A-H08-52666

SUMMARY

In the driving tools disclosed in Patent Documents 1 to 3 among the conventional driving tools, it has not been easy to drive the fastening piece at an accurate position. In the driving tool disclosed in Patent Document 4, its structure is complicated, which incurs an increase of weight, and possibility of breakdown is increased. In the driving tool disclosed in Patent Document 5, because the nail is driven in a manner of rubbing the push lever, the push lever may be worn out and must be exchanged, resulting in deterioration of durability.

In view of the above, it is an object of the invention to provide a combustion type driving tool capable of driving a fastening piece at an accurate position, which is lightweight and has high durability.

In order to solve the above described problem, there is provided according to the invention, a combustion type driving tool including a housing, a combustion chamber frame which is provided in the housing, and can move in one direction and in the other direction thereby to define a combustion chamber when it has moved in the other direction, and moving means which can select either of a manual operation valid state and a manual operation invalid state, and permits the combustion chamber frame to move in the other direction by manual operation, only in the manual operation valid state.

In the combustion type driving tool having the above described structure, it would be preferable that the moving means includes a link mechanism, the link mechanism having a connection part connected to the combustion chamber frame at its one end, an operation part which can be pressed at its other end, and a rotation shaft provided between the connection part and the operation part and extending in a direction substantially perpendicular to a moving direction of the combustion chamber frame to be selectively positioned, so that the manual operation valid state can be obtained by the positioning, wherein the link mechanism is constructed in such a manner that the operation part can rotate around the rotation shaft when it is manually pressed, and the connection part can move in the other direction.

According to these structures, it is possible to move the combustion chamber frame without employing a so-called push lever in the prior art. Therefore, there is no necessity of mounting the push lever which is a component other than the structure related to injection of the fastening piece, at a position where the fastening piece is injected. In this manner, visibility of the part for injecting the fastening piece can be enhanced. Moreover, because the movement of the combustion chamber frame is effected by the link mechanism, excessive increase of the components can be avoided, and hence, the combustion type driving tool can be made lightweight, as a whole.

Moreover, it would be preferable that the housing is further provided with a nose part capable of holding a fastening piece, at its one end in the one direction, and has a contact member which is arranged between the nose part and the link mechanism, the contact member being provided with a contact part which can be projected from a distal end of the nose part at its one end, and a support part which supports the rotation shaft at the other end, wherein the contact member is constructed in such a manner that the contact member can move in the one direction in a state where the contact part is not in contact with a driven member into which the fastening piece is driven, and cannot move in a state where the contact member is in contact with the driven member, whereby the manual operation valid state is obtained.

According to this structure, in the state where the contact member can move in the one direction, the support part cannot be a pivot of the link mechanism. As the results, only in the state where the contact member cannot move in the one direction, that is, in the state where the contact part is in contact with the driven member, the link mechanism can rotate around the support part as the pivot, whereby the combustion chamber can be formed.

Further, it would be preferable that the combustion type driving tool is further provided with a grip part which is extended from the housing in a direction substantially perpendicular to the moving direction, a gas bomb containing part provided in the housing, an ignition plug for igniting combustible gas which has been supplied from a gas bomb contained in the gas bomb containing part into the combustion chamber, and a trigger switch for controlling action of the ignition plug, wherein the operation part and the trigger switch are arranged in the grip part.

According to this structure, it is possible to operate both the trigger switch and the operation part by the hand which is gripping the grip part. As the results, necessity of operating the combustion type driving tool by two hands is eliminated.

According to the invention, it is possible to provide the combustion type driving tool which is made lightweight by reducing the components, and in which visibility of the fastening piece is enhanced.

DETAILED DESCRIPTION OF THE INVENTION

Figure 1:
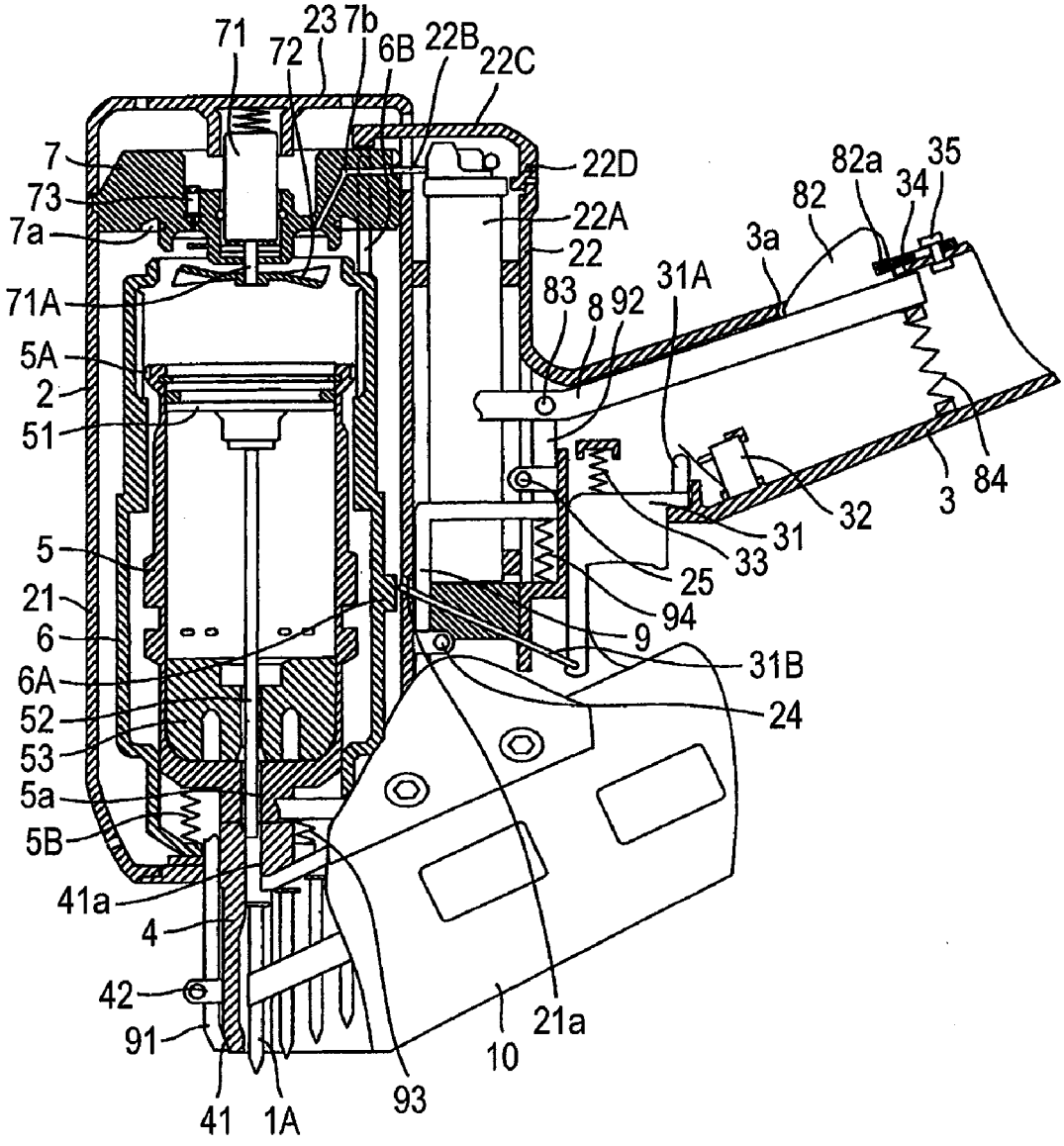
FIG. 1 is a sectional view of a combustion type driving tool in an embodiment according to the invention.

Now, a combustion type driving tool in an embodiment according to the invention will be described referring to FIGS. 1 to 5. A nail driving machine 1 which is the combustion type driving tool as shown in FIG. 1 includes mainly a housing 2, a handle part 3, a nose part 4, a link mechanism 8, a contact member 9, and a magazine 10. In the following description, one direction directed from the housing 2 toward the nose part 4 is defined as a downward direction, and the other direction opposite to the one direction is defined as an upward direction.

The housing 2 includes mainly a main housing 21, a bomb containing part 22, and a head cover 23. The main housing 21 is formed with an exhaust hole which is not shown, and a fixed hole 21*a* which opens at a position opposed to a projection 6A which will be described below. A cylinder 5, a combustion chamber frame 6, and a head cap 7 are mainly incorporated in the main housing 21. A pair of roller pins 24 (FIG. 3) for guiding the contact member 9 are provided at a position near the magazine 10 in an outer peripheral part of the main housing 21. The main housing 21 is further provided with a detecting switch, which is not shown, for detecting that the combustion chamber frame 6 has started to move upward.

The cylinder 5 is constructed in a shape of a cylinder which is substantially closed at its one end. The cylinder 5 is arranged in the main housing 21 so that an axial direction of the cylindrical shape is in parallel with a vertical direction, and fixed to the main housing 21 interposing a tail cover 41 which will be described below. A hole 5*a* is formed in a wall of the cylinder 5 at its one end which is substantially closed, and a blade 52 which will be described below is adapted to pass through the hole 5*a*. The cylinder 5 is provided with a seal part 5A adapted to come into contact with an inner peripheral face of the combustion chamber frame 6, on a circumferential edge of an opening in an upper part thereof. Moreover, the cylinder 5 is provided with a spring 5B for urging the combustion chamber frame 6 downward, at a lower end part thereof.

A piston 51, the blade 52, and a bumper 3 are incorporated in the cylinder 5.

The piston 51 is formed in a substantially disc-like shape, and provided in contact with an inner peripheral face of the cylinder 5, interposing a plurality of sealing members, thereby to define a space inside the cylinder 5 into an upper space and a lower space. The blade 52 is arranged below the piston 51, and extended to an exterior of the cylinder 5 passing through the hole 5*a*. The bumper 53 is arranged below the piston 51 in a lower end part of the cylinder 5. Accordingly, even in case where the piston 51 has moved downward, the piston 51 is restrained by the bumper 53 from directly getting in touch with the wall of the cylinder 5 around the hole 5*a*. In addition, the bumper 53 absorbs a shock of the piston 51, when a nail 1A which will be described below has been driven.

The combustion chamber frame 6 is formed in a cylindrical shape which is open at both ends, and arranged so as to move up and down with respect to the cylinder 5 in a state where the cylinder 5 is positioned inside the cylindrical shape. The cylinder 5 is positioned in a lower end part of the combustion chamber frame 6, and a spring 5B is interposed between the lower end part of the combustion chamber frame 6 and the cylinder 5. Accordingly, an urging force directed downward with respect to the cylinder 5 is applied to the combustion chamber frame 6 by the spring 5B. An inner face of the combustion chamber frame 6 is so constructed that an entirety of the inner face may come into contact with the seal part 5A, when the combustion chamber frame 6 has moved upward against the urging force of the spring 5B. Consequently, when the combustion chamber frame 6 has moved upward, air tightness can be maintained in a contact part between the inner peripheral face of the combustion chamber frame 6 and the seal part 5A.

The combustion chamber frame 6 is provided with the projection 6A on its outer face, at a position opposed to the fixed hole 21*a*. A pressure rod 6B extending upward is provided at an upper end of the combustion chamber frame 6. The pressure rod 6B is so constructed as to come into contact with one end of a bomb cap 22C, which will be described below, to urge the bomb cap 22C, when the combustion chamber frame 6 has moved to the uppermost position. The link mechanism 8 which will be described below is connected to an upper part of the combustion chamber frame 6 by means of a connection part 81 so as to rotate with respect to the combustion chamber frame 6.

The head cap 7 is arranged above the combustion chamber frame 6 and fixed to the main housing 21. A recess 7*a* adapted to be engaged with an upper end part of the combustion chamber frame 6 is formed in a lower face part of the head cap 7. When the combustion chamber frame 6 has moved upward and the upper end part of the combustion chamber frame 6 has been engaged with the recess 7*a*, air tightness can be maintained in this engaged part.

Figure 2:
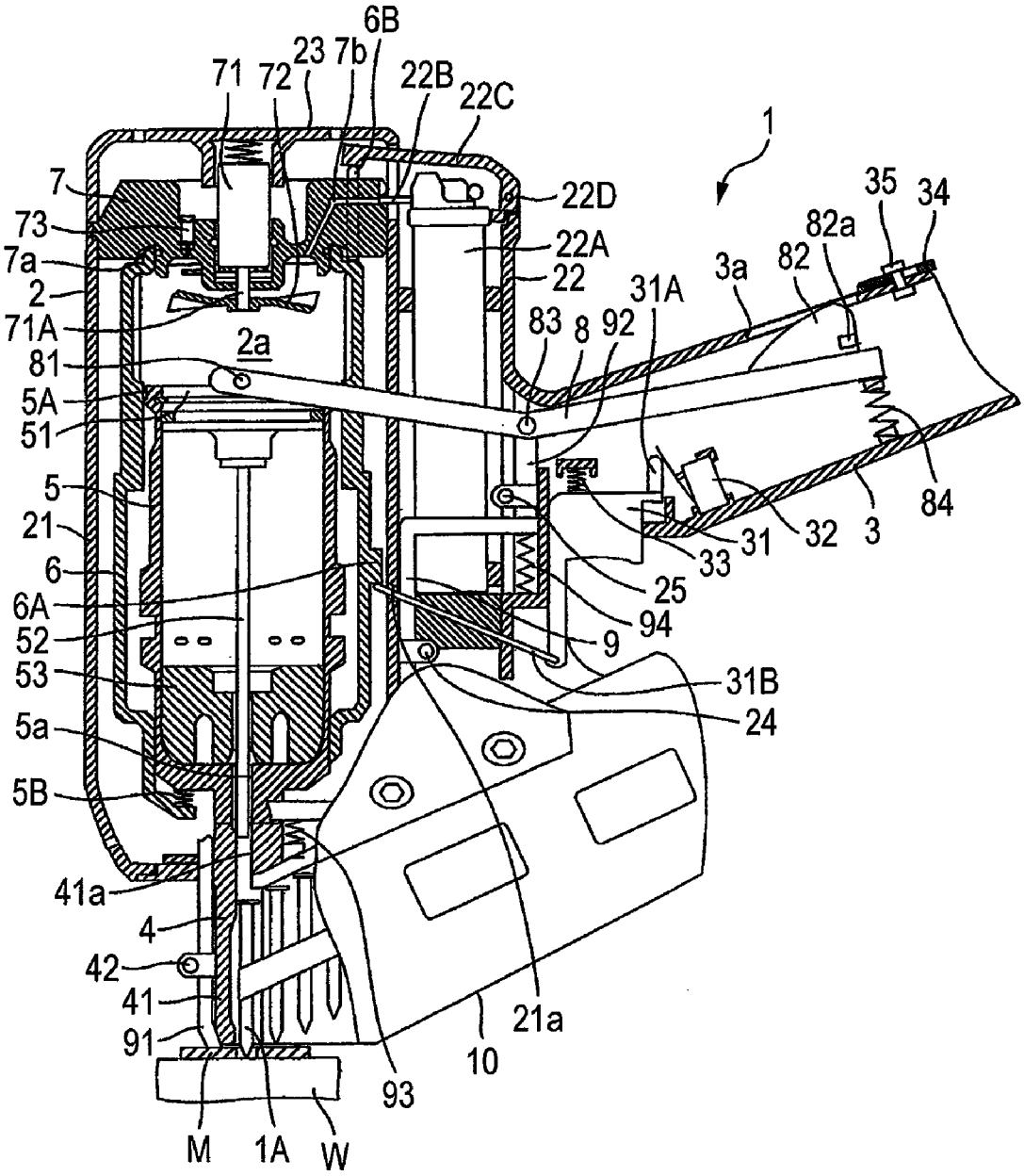
FIG. 2 is a sectional view of the combustion type driving tool in the embodiment according to the invention in a state where the driving tool is contacted with a driven member.

In a state where the combustion chamber frame 6 has moved upward, the air tightness is maintained between the combustion chamber frame 6 and the head cap 7, and between the combustion chamber frame 6 and the cylinder 5. As the results, a combustion chamber 2*a* is defined by cooperation of the cylinder 5, the piston 51 in the cylinder 5, the combustion chamber frame 6, and the head cap 7 (FIG. 2).

The head cap 7 is mainly provided with a motor 71, a fan 72, and an ignition plug 73. The motor 71 is provided in such a manner that its rotation shaft 71A is arranged in parallel with the vertical direction and a distal end of the rotation shaft 71A is projected into the combustion chamber 2*a*, and resiliently held by the head cap 7. When the detecting switch, which is not shown, provided on the main housing 21 has detected that the combustion chamber frame 6 has moved to the uppermost position, an electric power is supplied to the motor 71 from a battery which is not shown, whereby the motor 71 is driven to rotate.

The fan 72 is provided on the rotation shaft 71A in the combustion chamber 2*a* so as to be driven to rotate by the motor 71. When the fan 72 rotates in the combustion chamber 2*a*, a combustible gas supplied into the combustion chamber 2*a* is agitated thereby to form a favorable mixture of gas, and an exhaust gas after the combustible gas has burned can be favorably exhausted from the combustion chamber 2*a*. Moreover, the fan 72 takes a fresh air into the combustion chamber 2*a* through a hole, which is not shown, formed in the head cover 23 which will be described below.

The ignition plug 73 is arranged in such a manner that its igniting portion is positioned on a plane of the head cap 7 which defines the combustion chamber 2*a*. Accordingly, it is possible to ignite the combustible gas which has been supplied into the combustion chamber 2*a*. Moreover, the head cap 7 is formed with a flow passage 7*b* for introducing the combustible gas supplied from a gas bomb 22A, which will be described below, into the combustion chamber 2*a*.

The bomb containing part 22 is provided on a side part of the main housing 21 along the vertical direction, and has the gas bomb 22A contained therein, and a bomb cap 22C in its upper part. Moreover, a roller pin 25 for guiding a support part 92 of the contact member 9, which will be described below, is provided on an inner peripheral face of the bomb containing part 22.

The gas bomb 22A reserves the combustible gas therein, and is so constructed that a certain amount of the combustible gas can be injected from a nozzle 22B which is provided at an upper end thereof. A distal end of the nozzle 22B is connected to the flow passage 7*b*, and the combustible gas can be injected into the flow passage 7*b*, when the gas bomb 22A is urged by the bomb cap 22C toward the main housing 21.

The bomb cap 22C is formed in a substantially L-shape in section, and attached to the bomb containing part 22 so as to rotate by means of a rotation shaft 22D, covering an upper part of the gas bomb 22A. When one end of the bomb cap 22C is pushed up by the pressure rod 63, the bomb cap 22C rotates around the rotation shaft 22D, so that the other end of the bomb cap 22C can urge the gas bomb 22A toward the main housing 21.

The head cover 23 which is provided above the main housing 21 protects the head cap 7, and at the same time, holds the motor 71.

The handle part 3 is extended from the bomb containing part 22 in the housing 2 in a direction intersecting the vertical direction, and includes mainly a trigger 31, a micro switch 32, and a stopper 34. Moreover, an opening 3*a* through which an operation part 82 which will be described below is exposed is formed at a position adjacent to a distal end of the handle part 3.

The trigger 31 is provided at a lower side of a base end part of the handle part 3 and urged downward by a spring 33. The trigger 31 is provided with a push 31A and a stop bar 31B. The push 31A is so adapted as to come into contact with the micro switch 32 so that an action of the trigger 31 when it is pulled can be transmitted to the micro switch 32.

The stop bar 31B is extended from a lower end part of the trigger 31, passing through the fixed hole 21*a*, and a distal end of the stop bar 31B is projected into the main housing 21 at a position close to the projection 6A. In case where the combustion chamber frame 6 and the projection 6A have moved upward, the stop bar 31B is projected into the main housing 21 and engaged with a lower part of the projection 6A (FIG. 2), when the trigger 31 is pulled, thereby to block the downward movement of the projection 6A. In case where the combustion chamber frame 6 and the projection 6A have not moved upward, the stop bar 31B is butted against the projection 6A, when the trigger 31 is pulled, thereby to restrain an excessive projection of the stop bar 31B into the main housing 21. In the state where the projection of the stop bar 31B is restrained, a moving amount of the trigger 31 connected to the stop bar 31B is also restrained.

The micro switch 32 is provided near the trigger 31, and connected to the ignition plug 73 by means of an electric wire which is not shown. The micro switch 32 is so constructed that it comes into contact with the push 31A to be turned on, in a state where the trigger 31 has been pulled and moved to the most. In the state where the micro switch 32 is turned on, it is possible to fly a spark at the ignition plug 73 thereby to ignite the combustible gas.

Figure 5:
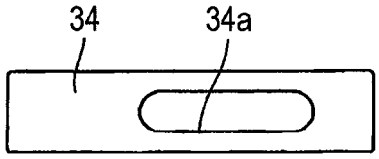
FIG. 5 is a plan view showing a shape of a stopper in the combustion type driving tool in the embodiment according to the invention.

The stopper 34 is attached to the distal end part of the handle part 3 with a rivet 35. As shown in FIG. 5, the stopper 34 is formed with an elongated hole 34*a*, and attached to the handle part 3, by passing the rivet 35 through this elongated hole 34*a*. Therefore, according to movement of the rivet 35 in the elongated hole 34*a*, the stopper 34 can move with respect to the rivet 35. In case where the stopper 34 has moved, the stopper 34 can be engaged with a cut-out 82*a* formed in the operation part 82 which will be described below.

The nose part 4 is provided in the lower part of the main housing 21, and includes mainly a tail cover 41. The tail cover 41 is fixed to the main housing 21, and holds the cylinder 5. The tail cover 41 is formed with a hole 41*a* which is communicated with the hole 5*a*. A roller pin 42 for guiding a contact part 91 of the contact member 9, which will be described below, is provided at a position near the distal end part of the tail cover 41.

The magazine 10 which contains a plurality of nails 1A is connected to the nose part 4. The nail 1A which has been supplied from the magazine 10 is arranged below the hole 41*a* in such a manner that a distal end of the nail 1A may slightly protrude from a lower end of the tail cover 41. The magazine 10 may be provided with a cover for covering the protruded part of the nail 1A.

Figure 4:
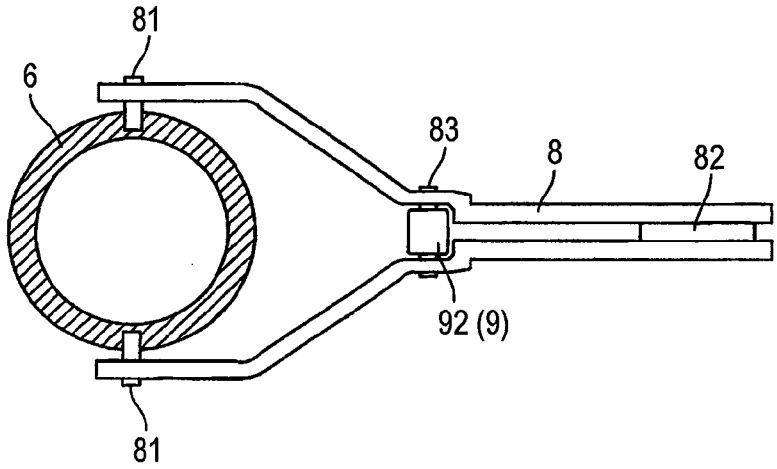
FIG. 4 is a plan view partly in section showing relation between a link mechanism and a combustion chamber frame in the combustion type driving tool in the embodiment according to the invention.

The link mechanism 8 is provided so as to bridge respective interiors of the main housing 21, the bomb containing part 22, and the handle part 3, as shown in FIG. 2. The link mechanism 8 includes mainly the connection part 81, the operation part 82, and the rotation shaft 83, and is formed by bending two rod members, as shown in FIGS. 2 and 4. The connection part 81 is arranged at one end of the link mechanism 8, and includes a pair of shaft portions 81, 81 extending in a direction perpendicular to an axial direction of the combustion chamber frame 6, as shown in FIG. 4. These shaft portions 81, 81 are connected to the combustion chamber frame 6 in a manner of clamping the combustion chamber frame 6 so as to rotate with respect to the combustion chamber frame 6.

The operation part 82 is arranged at the other end of the link mechanism 8, and disposed inside the handle part 3 in such a manner that it can be exposed outward from the handle part 3 through the opening 3*a*, as shown in FIGS. 1 and 2. The operation part 82 is formed with the cut-out 82*a* at a position where the operation part 82 can be exposed outward from the handle part 3, which is the position adjacent to the distal end of the handle part 3. When the stopper 34 is engaged with this cut-out 82*a*, the operating part 82 is restrained from moving into the handle part 3. Moreover, a spring 84 for urging the operation part 82 to move outward from the handle part 3 is provided inside the handle part 3, at a position opposed to the operation part 82.

The rotation shaft 83 is positioned in the bomb containing part 22, at a substantially intermediate position between the connection part 81 and the operation part 82, in a direction perpendicular to the vertical direction, and held by the support part 92 which will be described below.

Figure 3:
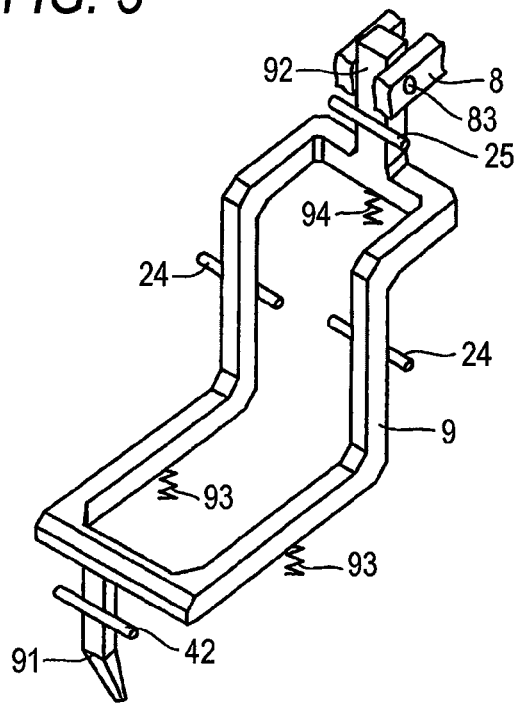
FIG. 3 is a perspective view showing a structure of a contact member in the combustion type driving tool in the embodiment according to the invention.

The contact member 9 is provided between the distal end portion of the nose part 4 and the link mechanism 8, as shown in FIG. 1, and includes mainly the contact part 91 and the support part 92, as shown in FIGS. 1 and 3. The contact member 9 is urged upward by a plurality of springs 93, 93, 94, as shown in FIG. 3, and its upward and downward movements are guided by a plurality of the roller pins 24, 24, 25, 42. Therefore, the contact member 9 is in a state where it has moved upward, while nail driving motion is not conducted. The contact member 9 is so constructed as not to move in a direction intersecting the vertical direction, even in case where the nail driving motion is conducted.

A plurality of the springs 93, 93, 94 have such urging forces that they push the contact member 9 upward only with weak forces. Therefore, when a force for urging the contact member 9 downward is applied, a plurality of the springs 93, 93, 94 permit the downward movement of the contact member 9.

The contact part 91 is arranged along the tail cover 41, in such a manner that its distal end portion may be at a substantially same position as the distal end portion of the tail cover 41 in a state where the nail driving motion is not conducted, as shown in FIG. 1. Accordingly, visual recognition of the nail 1A which is protruded from the end portion of the tail cover 41 will not be hindered, and when the nail 1A is driven into the driven member at a determined position, the position can be accurately and reliably restricted.

The support part 92 is arranged inside the bomb containing part 22, at an end opposite to the contact part 91, and supports the rotation shaft 83 so as to rotate. For reference, a state where the contact part 91 is in contact with the driven member and the support part 92 is unable to move downward with respect to the housing 2 and so on is defined as a manual operation valid state. On the other hand, a state where the support part 92 is allowed to move downward with respect to the housing 2 and so on is defined as a manual operation invalid state.

In the nail driving machine 1 having the above described structure, in case of driving the nail 1A into a wood W through a hole of a metal M, the handle part 3 is gripped by one hand, putting a finger on the trigger 31 and extending a palm along the operation part 82. Then, a distal end of the nail 1A is arranged in the hole of the metal M, and the distal end of the nose part 4 is pressed to the metal M. Because the distal end of the nail 1A is protruded from the distal end portion of the nose part 4, and a conventional push lever or the like which would hinder visual recognition of the nail 1A is not provided, the visibility of the nail 1A is improved, and it is possible to accurately and reliably position the distal end of the nail 1A in the hole of the metal M.

Because the distal end of the nose part 4 is in contact with the metal M, the contact part 91 of the contact member 9 positioned at the distal end of the nose part 4 is also in contact with or very close to the metal M. In this state, the contact member 9 is unable to move downward with respect to the nose part 4, the cylinder 5 connected to the nose part 4, and the housing 2. Consequently, the support part 92 of the contact member 9 at the opposite end to the contact part 91 is also unable to move downward, whereby the manual operation valid state is obtained. In the manual operation valid state, when the operation part 82 is pushed by the palm to move downward, the link mechanism 8 makes a rotary movement around the rotation shaft 83, because the rotation shaft 83 which is supported by the support part 92 is unable to move downward. The connection part 81 positioned at the one end is moved upward by this rotary movement, and the combustion chamber frame 6 connected to the connection part 81 is also moved upward to be brought into contact with the head cap 7, whereby the combustion chamber 2*a* is defined.

The detection switch which is not shown is turned on in association with the upward movement of the combustion chamber frame 6, and supplies electric power to the motor 71 thereby to rotate the fan 72. At the same time when the combustion chamber 2*a* is defined, the bomb cap 22C is urged by the pressure rod 6B, and a certain amount of the combustible gas is injected from the gas bomb 22A into the combustion chamber 2*a* through the flow passage 7*b*. The combustible gas which has been injected is agitated by the fan 72 and mixed with air, whereby a mixture of the gas is created.

By pulling the trigger 31 in this state, the micro switch 32 is turned on, and the electric power is supplied from the battery, which is not shown, to the ignition plug 73, whereby sparks fly in the combustion chamber 2*a* to ignite the gas mixture. The gas mixture which has been ignited explodes and burns to instantly push the piston 51 and the blade 52 downward, and strikes the nail 1A positioned below the hole 41*a* thereby to drive the nail 1A into the wood W through the hole of the metal M. When the trigger 31 is pulled in the state where the combustion chamber frame 6 has moved upward, the stop bar 31B is engaged with the projection 6A thereby to restrain the downward movement of the combustion chamber frame 6. As the results, downward movements of the combustion chamber frame 6 and the connection part 81 by a repulsive force of the explosion and combustion, which would push the operation part 82 to return, are restrained.

All the operations of the trigger 31 and the operation part 82 related to this driving motion are conducted by the one hand which is gripping the handle part 3. Because there is no necessity of operating the nail driving machine 1 by both hands, it is possible to conduct other motions which are not related to the operation of the nail driving machine 1, for example, holding the wood by the other hand, while the handle part 3 is gripped by the one hand. Moreover, because the movement of the combustion chamber frame 6 is performed by the link mechanism 8, components of the nail driving machine 1 are not excessively increased in number. As the results, the nail driving machine 1 can be made lightweight as a whole, and operability by the one hand is further enhanced.

After the gas mixture has been burned inside the combustion chamber 2*a* and the nail 1A has been driven into the wood W, the cylinder 5 and the combustion chamber frame 6 are cooled down with atmosphere, and pressure in the combustion chamber 2*a* is lowered. Because the space below the piston 51 which is defined by the piston 51 and the cylinder 5 becomes high-pressure due to the downward movement of the piston 51, a pressure difference is created between the upper face and the lower face of the piston 51, whereby the piston 51 and the blade 52 move upward and return to the state before driving. When the trigger 31 and the operation part 82 are returned to the original position, the combustion chamber frame 6 moves downward by the urging force of the spring 5B, and a fresh air is taken into the space which functions as the combustion chamber 2*a* by the fan 72, whereby the work is completed.

In the above described nail driving motion, in case where the trigger 31 is pulled before the operation part 82 is pressed, the stop bar 31 protrudes into the main housing 21 while the combustion chamber frame 6 is not yet moved upward. However, the stop bar 31 is butted against the projection 6A thereby to prevent the trigger 31 from being completely pulled. As the results, the push 31A connected to the trigger 31 prevents the micro switch 32 from being turned on, and the ignition plug 73 will not be energized. In this manner, useless power consumption can be depressed.

On the other hand, in a state where the nose part 4 is not in contact with the driven member such as the work W, the support part 92 provided on the contact member 9 is in the manual operation invalid state. When the operation part 82 is pressed in this state, the rotation shaft 83 rotates around the connection part 81 as an axis of the rotation, since the urging forces of a plurality of the springs 93, 93, 94 are weak, whereby the support part 92 is pushed downward. In this case, the rotation shaft 83 is unable to be a pivot of the link mechanism 8, and the combustion chamber frame 6 will not move upward. Consequently, the detecting switch in the main housing 21 will not be turned on, thus preventing power supply to the motor 71. Moreover, because the combustion chamber frame 6 has not moved upward, the trigger 31 is restrained from being completely pulled, and power supply to the ignition plug 73 is also restrained. As the results, it is possible to depress useless consumption of the electric power and to prevent erroneous injection of the nail 1A.

Figure 6:
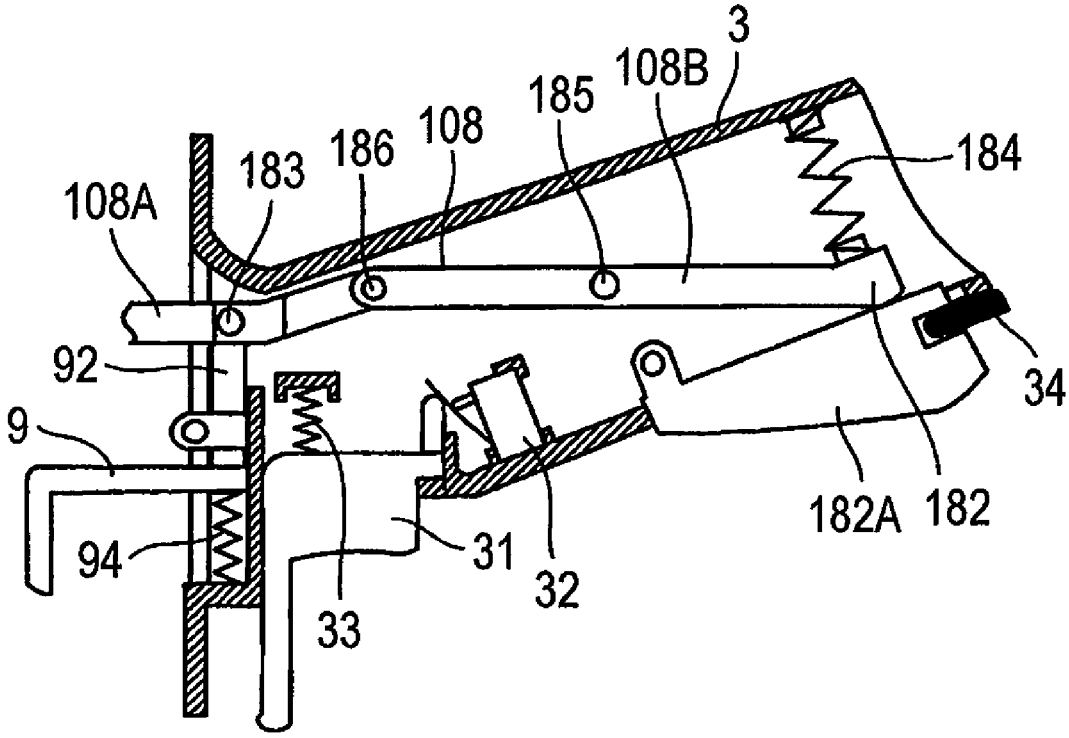
FIG. 6 is a sectional view of a handle part in a modification of the combustion type driving tool in the embodiment according to the invention.

The combustion type driving tool according to the invention is not limited to the above described embodiment, but various modifications and improvements can be made within a scope described in the claims. For example, as shown in FIG. 6, it is possible to provide an operation part 182 in a lower part of the handle part 3.

In this structure, a link mechanism 108 includes a first link 108A provided with a connection part, which is not shown, and a rotation shaft 183, and a second link 108B provided with the operation part 182.

The connection part, which is not shown, and the rotation shaft 183 in the first link 108A are constructed substantially in the same manner as the connection part 81 and the rotation shaft 83 in the embodiment according to the invention. In addition, a rotation connecting shaft 186 which rotatably interconnects the first link 108A and the second link 108B around an axis in parallel with the rotation shaft 183 is provided in the other end part of the first link 108A.

The second link 108B is rotatably fitted to the handle part 3 by means of a shaft 185 which is in parallel with the rotation shaft 183, in a substantially center part thereof. The second link 108B is connected to the rotation connecting shaft 186 at its one end, and provided with the operation part 182 at the other end. The operation part 182 is in contact with a push part 182A which is provided on the handle part 3, and adapted to move upward against urging force of a spring 184, when the push part 182A is gripped and urged upward.

By pushing up the push part 182A in the state where the support part 92 and the contact member 9 are unable to move downward, the operation part 182 is pushed up and the second link 108B is rotated around the shaft 185 thereby to move the rotation connecting shaft 186 downward. In association with the downward movement of the rotation connecting shaft 186, the first link 108A rotates around the rotation shaft 183, and the connection part which is not shown is moved upward, whereby the combustion chamber frame which is not shown can be moved upward.

What is claimed is:

1. A combustion type driving tool comprising:

a housing;

a combustion chamber frame which is provided in said housing, and can move in one direction and in the other direction thereby to define a combustion chamber when the combustion chamber frame has moved in the other direction; and moving means which can select either of a manual operation valid state and a manual operation invalid state, and permits said combustion chamber frame to move in the other direction by manual operation, only in the manual operation valid state, wherein said moving means includes a link mechanism, said link mechanism having a connection part connected to said combustion chamber frame at one end of the link mechanism, an operation part which can be pressed at another end of the link mechanism, and a rotation shaft provided between said connection part and said operation part and extending in a direction substantially perpendicular to a moving direction of said combustion chamber frame thereby to be selectively positioned, so that said manual operation valid state can be obtained by said positioning, wherein said link mechanism is constructed in such a manner that said operation part can rotate around said rotation shaft when the operation part is manually pressed, and said connection part can move in the other direction.

2. A combustion type driving tool as claimed in claim 1, wherein said housing is further provided with a nose part capable of holding a fastening piece, at one end of the housing in said one direction, and has a contact member which is arranged between said nose part and said link mechanism, said contact member being provided with a contact part which can be projected from a distal end of the nose part at one end of the contact member, and a support part which supports said rotation shaft at another end of the contact member, wherein said contact member is constructed in such a manner that said contact member can move in said one direction in a state where said contact part is not in contact with a driven member into which said fastening piece is driven, and can not move in a state where said contact member is in contact with said driven member, whereby said manual operation valid state is obtained.

3. A combustion type driving tool as claimed in claim 1, wherein said combustion type driving tool is further provided with a grip part which is extended from said housing in a direction substantially perpendicular to said moving direction, a gas bomb containing part provided in said housing, an ignition plug for igniting combustible gas which has been supplied from a gas bomb contained in said gas bomb containing part into said combustion chamber, and a trigger switch for controlling action of said ignition plug, wherein said operation part and said trigger switch are arranged in said grip part.

* * * * *